US010883229B2

(12) United States Patent
Johnston

(10) Patent No.: US 10,883,229 B2
(45) Date of Patent: Jan. 5, 2021

(54) INDUCTION COIL DRIVER CARD FOR A RAILROAD SWITCH HEATER SYSTEM

(71) Applicant: Jeffrey Ross Johnston, Jacksonville, FL (US)

(72) Inventor: Jeffrey Ross Johnston, Jacksonville, FL (US)

( * ) Notice: Subject to any disclaimer, the term of this patent is extended or adjusted under 35 U.S.C. 154(b) by 205 days.

(21) Appl. No.: 16/152,155

(22) Filed: Oct. 4, 2018

(65) Prior Publication Data

US 2019/0040586 A1 Feb. 7, 2019

Related U.S. Application Data

(63) Continuation-in-part of application No. 16/152,117, filed on Oct. 4, 2018, and a continuation-in-part of application No. 15/834,038, filed on Dec. 6, 2017, now Pat. No. 10,626,560, which is a continuation-in-part of application No. 15/062,290, filed on Mar. 7, 2016, now abandoned.

(60) Provisional application No. 62/567,992, filed on Oct. 4, 2017, provisional application No. 62/567,999, filed on Oct. 4, 2017, provisional application No. 62/430,460, filed on Dec. 6, 2016, provisional application No. 62/166,497, filed on May 26, 2015.

(51) Int. Cl.

| | |
|---|---|
| ***E01B 7/24*** | (2006.01) |
| ***H05B 6/36*** | (2006.01) |
| ***H05B 6/06*** | (2006.01) |
| ***H05B 6/04*** | (2006.01) |
| ***H05B 6/10*** | (2006.01) |
| ***H05B 6/40*** | (2006.01) |

(52) U.S. Cl.

CPC ..... *E01B 7/24* (2013.01); *H05B 6/04* (2013.01); *H05B 6/06* (2013.01); *H05B 6/101* (2013.01); *H05B 6/36* (2013.01); *H05B 6/40* (2013.01)

(58) Field of Classification Search

CPC .... E01B 7/24; E01B 7/28; H05B 6/40; H05B 6/36; H05B 6/06; H05B 6/04; H05B 6/02; H05B 6/101; H05B 6/10; H05B 6/103; H05B 6/104

See application file for complete search history.

(56) References Cited

U.S. PATENT DOCUMENTS 4,429,845 A * 2/1984 Stover ..... E01B 7/24 104/280

6,664,521 B1 * 12/2003 Kondo ..... E01B 7/24 219/635

* cited by examiner

*Primary Examiner* — Shawntina T Fuqua

(57) ABSTRACT

An induction coil driver card for a railroad switch consists of a main power supply, a control unit, at least one induction heating unit, and an interface driver. The main power supply is electrically connected to the at least one induction heating unit that is used to generate eddy current fields. The generated eddy current field excites the atoms within the railroad switch resulting in elevated temperatures. The power input to the induction heating unit is managed via the control unit. The interface driver allows the user to control the frequency ranges received by the induction heating unit by utilizing the control unit. The interface driver also allows the user to have remote access via a wireless cellular modem.

11 Claims, 6 Drawing Sheets

INDUCTION COIL DRIVER CARD FOR A RAILROAD SWITCH HEATER SYSTEM

The current application claims a priority to the U.S. Provisional Patent application Ser. No. 62/567,999 filed on Oct. 4, 2017.

FIELD OF THE INVENTION

The present invention relates generally to the field of railroad switch heaters. More specifically, the present invention is an induction coil driver card unit that utilizes eddy current fields to satisfy the heating requirements of a railroad switch.

BACKGROUND OF THE INVENTION

Railroad switches are used to guide a train from one track to another. The railroad switches consist of a moving-point train track rail and a fixed train track rail which are positioned in parallel to each other. The moving-point train track rail has the capability to shift positions and enable redirection. The space between the moving-point rail and the fixed train track rail is vulnerable to hold snow or ice during cold weather conditions. The snow build-up during cold weather conditions can affect the overall functionality and longevity of the railroad switch.

Various heating methods are currently used to remove snow or ice that builds up in between the moving-point train track rail and the fixed train track rail. The use of cal-rod units is one such method that generates heat along the train track rail. Even though cal-rod units have certain benefits, there are notable drawbacks that need to be addressed as well. As an example, cal-rod units draw a substantial amount of current to heat the rail. Generally, 480-volts of power is required to generate 500 Watts per foot of the train track rail. The high voltage electrifies the railroad switch and generates a temperature of 160-Fahrenheit. Thus, the overall cost related to cal-rod units can be financially disadvantageous. The length of the cal-rod units is another disadvantage. Based upon the length of the train track rail that needs to be heated, the required length of the cal-rod unit can be up to 30-feet long.

The need to monitor the heating system continuously is another disadvantage with existing heating systems. For instance, having to monitor the components of a heating system during cold weather temperatures can be a daunting task to the maintenance workers. Thus, the need for a heating system that can be controlled remotely is evident.

The objective of the present invention is to address the aforementioned issues. To do so, the present invention introduces an induction coil driver card that utilizes eddy current fields to generate heat within the fixed train track rail and the moving-point train track rail. By doing so, the present invention generates temperatures of up to 300-Fahrenheit. The present invention has the capability to adjust according to varying weather conditions and thus, improve overall efficiency of the present invention.

DETAIL DESCRIPTIONS OF THE INVENTION

All illustrations of the drawings are for the purpose of describing selected versions of the present invention and are not intended to limit the scope of the present invention.

The present invention introduces an induction coil driver card for a railroad switch heater system. The present invention utilizes eddy current fields to generate heat within a railroad switch so that snow or ice that is collected in between the train track rails of a railroad switch is removed via the heat radiated from the train track rails. In contrast to existing railroad switch heating systems, the overall configuration of the present invention allows the user to control and monitor the eddy current field as required.

Figure 1:
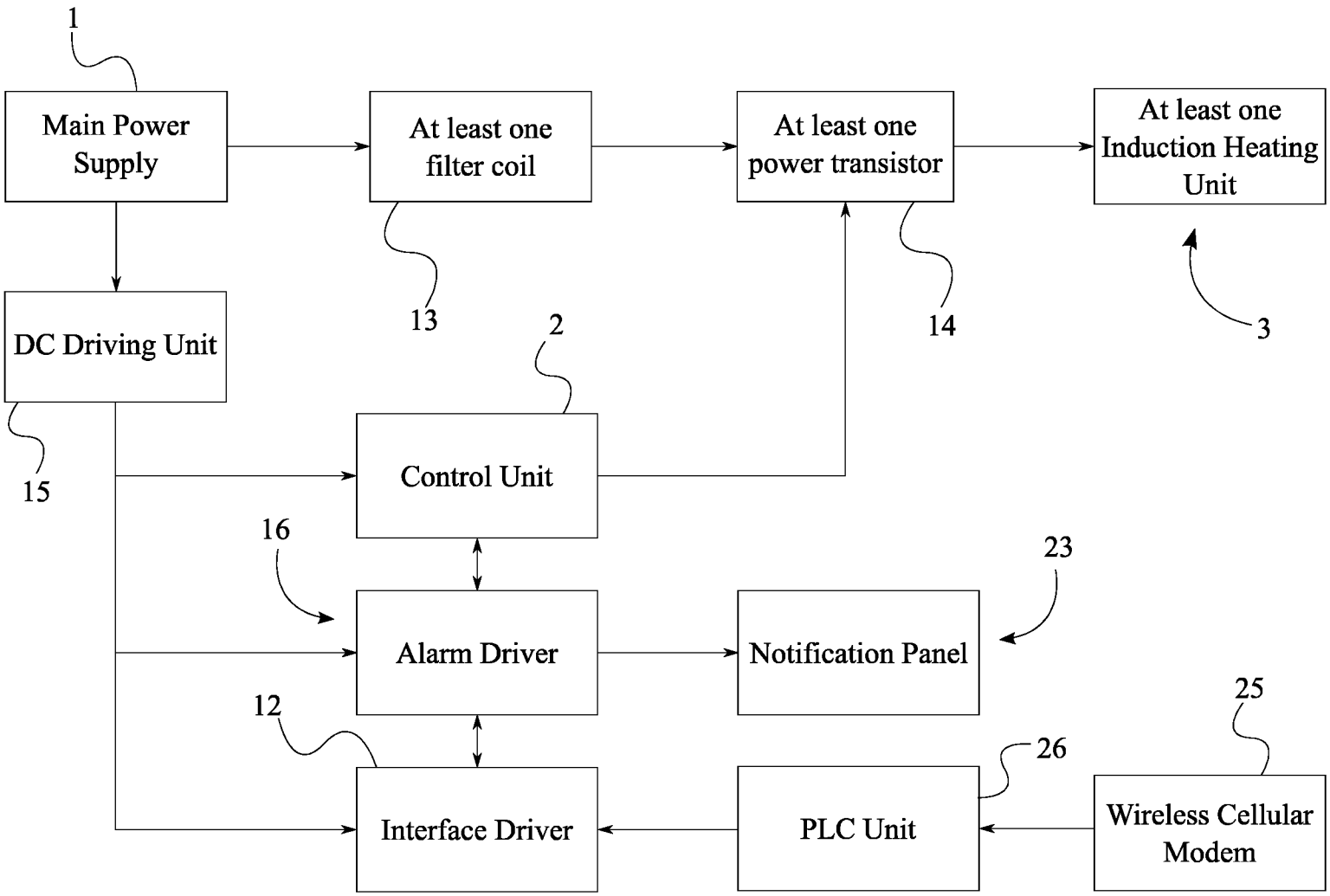
FIG. 1 is an illustration of the overall system of the present invention.

As illustrated in FIG. 1, to fulfill the intended functionalities, the present invention comprises a main power supply 1, a control unit 2, at least one induction heating unit 3, and an interface driver 12. The present invention functions with the electrical power supplied by the main power supply 1. In the preferred embodiment, the main power supply 1 is a 120-Volt single-phase alternating current (AC) power supply. However, the main power supply 1 can vary in different embodiments of the present invention. For example, in another embodiment of the present invention, the main power supply 1 can be a 480-Volt three-phase AC power supply. The control unit 2 preferably consists of a microcontroller that manages the overall power levels utilized within the present invention. More specifically, the control unit 2 ensures that only the required amount of electric power is used to generate the eddy current fields so that the overall energy usage of the present invention is minimized. The at least one induction heating unit 3 generates the eddy current field used to excite the atoms within the steel of the train track rails through an induction coil 4. The interface driver 12, which functions as the user interface, is used to control the functionalities of the present invention.

To transfer the electrical power throughout the present invention, the main power supply 1 is electrically connected to the control unit 2, the interface driver 12, and the induction coil 4. The interface driver 12 is electronically connected to the control unit 2 such that a line of communication can be established between the interface driver 12 and the control unit 2. To modulate the frequencies sent to the at least one induction heating unit 3, the control unit 2 is electronically connected to the at least one induction heating unit 3. Thus, according to the user input received from the interface driver 12, the control unit 2 can determine the overall power received from the main power supply 1 and transfer the required amount of electrical power to the at least one induction heating unit 3.

The present invention further comprises at least one filter coil 13 and at least one power transistor 14. The at least one filter coil 13 and the at least one power transistor 14 are used to control the power supply transferred to the at least one induction heating unit 3. To do so, the main power supply 1 is electrically connected to the at least one induction heating unit 3 through the at least one filter coil 13 and the at least one power transistor 14. The at least one filter coil 13 filters the incoming voltage to remove voltage spikes that can affect the overall longevity of the at least one power transistor 14. To do so, the at least one filter coil 13 is electronically connected to the at least one power transistor 14. The at least one power transistor 14 is utilized to maximize the longevity of the at least one induction heating unit 3 by varying the frequency ranges that are transferred to the at least one induction heating unit 3. To do so, the control unit 2 is electronically connected to the at least one induction heating unit 3 through the at least one power transistor 14. Preferably, the output range of the at least one power transistor 14 will be in a range of 20-40 Kilohertz (kHz).

To ensure that a filtered direct current (DC) voltage is provided from the main power supply 1 to the control unit 2, the present invention further comprises a DC driving unit 15. The main power supply 1 is electrically connected to the control unit 2 through the DC driving unit 15 such that a highly filtered 5-Volt (V) transistor-transistor logic service voltage is supplied to the control unit 2 in the preferred embodiment of the present invention. The output voltage from the DC driving unit 15 to the control unit 2 can be different in other embodiments of the present invention. To provide a filtered DC voltage to the interface driver 12, the main power supply 1 is electrically connected to the interface driver 12 through the DC driving unit 15.

Figure 3:
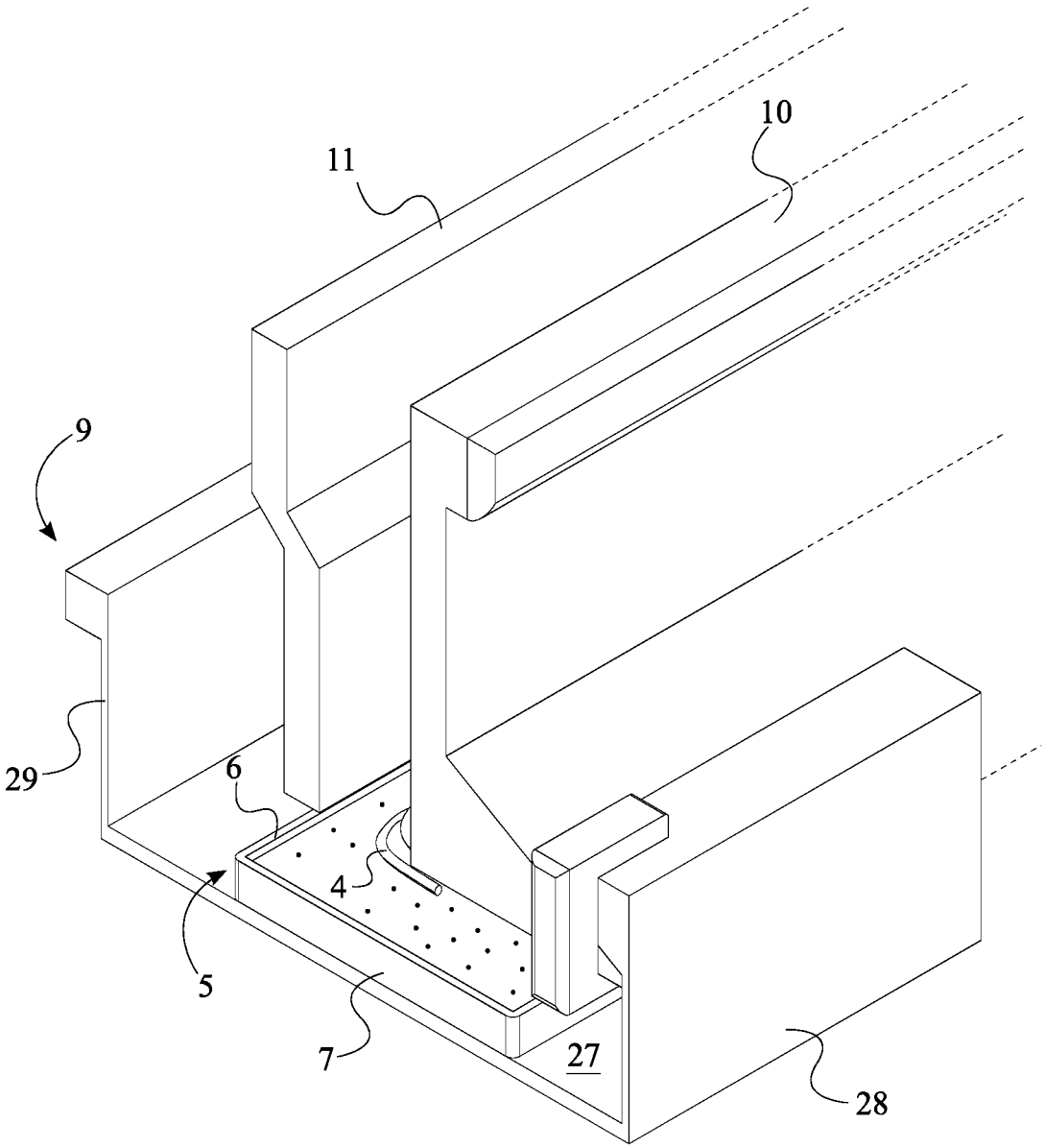
FIG. 3 is a perspective view of the at least one induction heating unit being used with a fixed train track rail and a moving-point train track rail.
Figure 4:
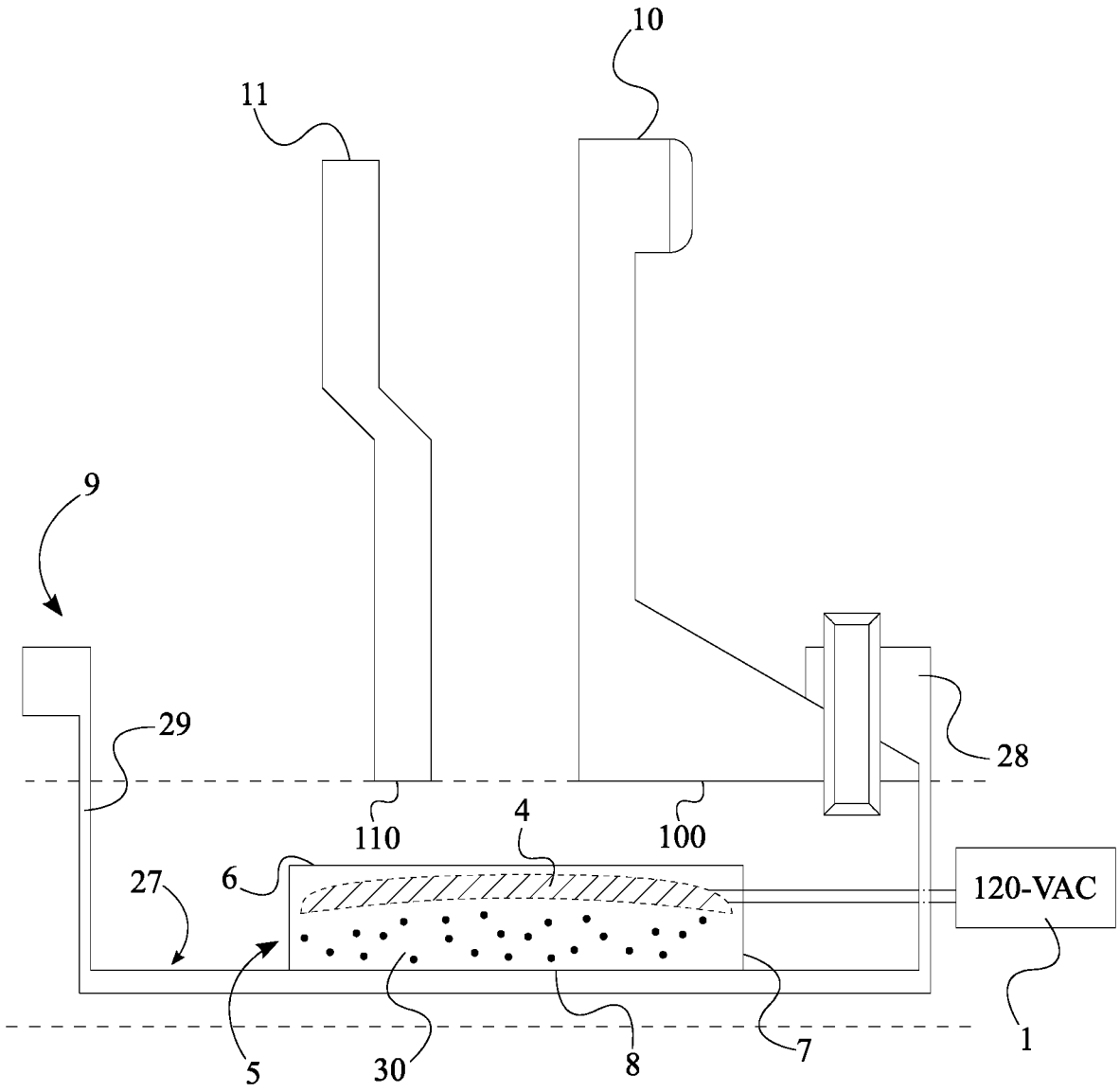
FIG. 4 is a front view of the at least one induction heating unit being used with the fixed train track rail and the moving-point train track rail.
Figure 5:
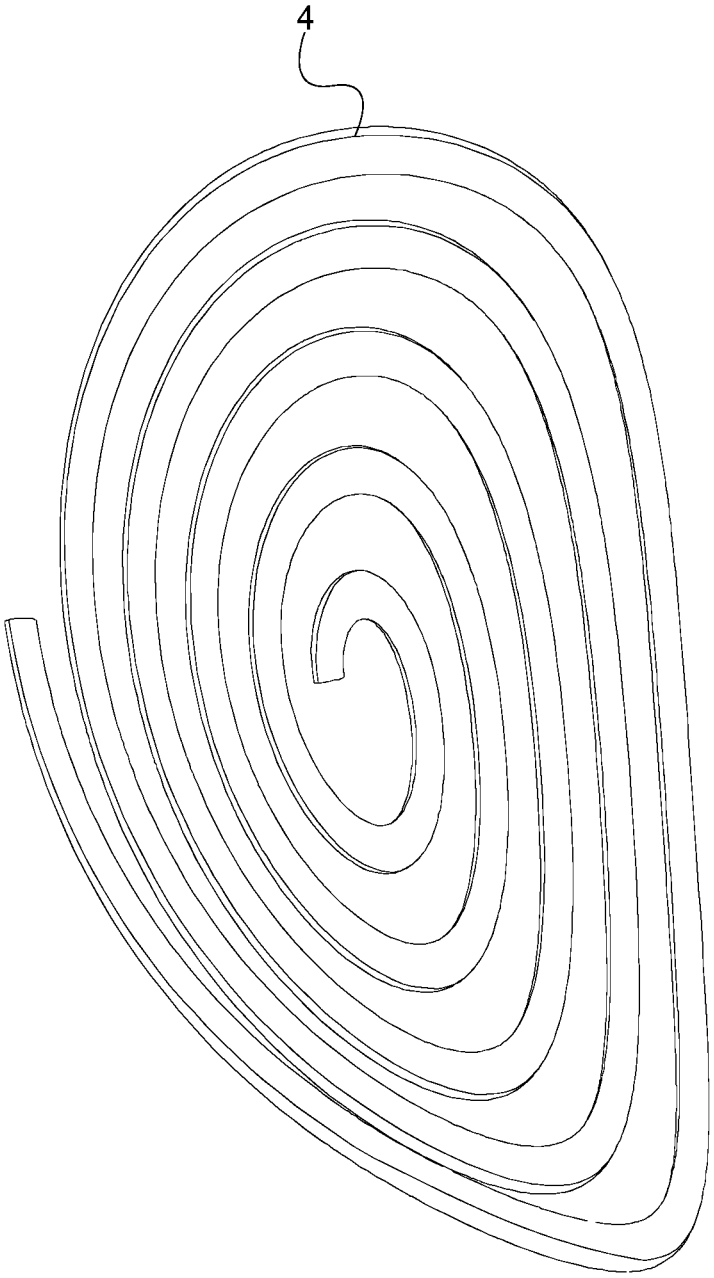
FIG. 5 is a perspective view of the induction coil of the at least one induction heating unit.
Figure 6:
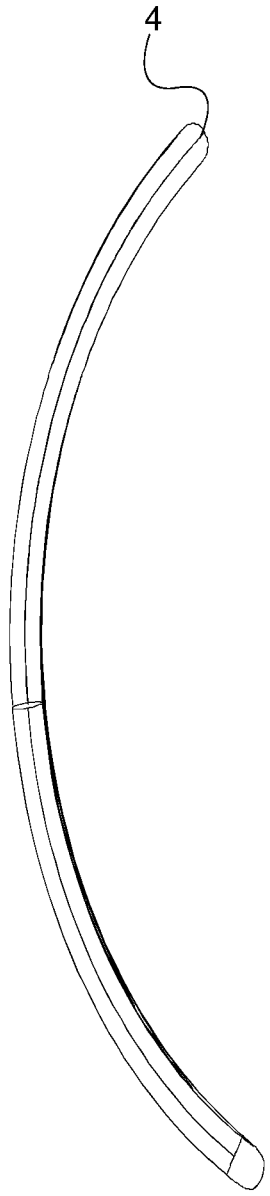
FIG. 6 is a side view of the induction coil.

As discussed earlier, the present invention utilizes eddy current fields in the process of removing snow or ice that accumulates in between the moving-point train track rail 11 and the fixed train track rail 10 of a railroad switch. To do so as shown in FIG. 3 and FIG. 4, in addition to the induction coil 4 the at least one induction heating unit 3 further comprises a holding case 5 and a mounting tray 9. The induction coil 4 is used to create the eddy current field that will generate heat within the moving-point train track rail 11 and the fixed train track rail 10. Preferably, the induction coil 4 is a pancake induction coil that is oblong and concave in shape as seen in FIG. 5 and FIG. 6. The oblong and concave shape is vital to create a wide eddy current field that will span across both the fixed train track rail 10 and the moving-point train track rail 11 when the at least one induction heating unit 3 is in use. To provide electrical insulation, the induction coil 4 is coated in a high-temperature magnetic wire enamel. The eddy current field generated from the induction coil 4, excites the atoms within the material of both the fixed train track rail 10 and the moving-point train track rail 11. Since steel is generally used to manufacture train track rails, the eddy current fields excites the atoms within the steel of the fixed train track rail 10 and the moving-point train track rail 11. The activation of the atoms results in elevated temperatures within the fixed train track rail 10 and the moving-point train track rail 11. The heat radiating from both the fixed train track rail 10 and the moving-point train track rail 11 removes any snow or ice accumulated in between the fixed train track rail 10 and the moving-point train track rail 11. Since the induction coil 4 does not generate any heat within the induction coil 4, the at least one induction heating unit 3 provides a safe working environment for the maintenance personnel.

As seen in FIG. 4, in the preferred embodiment of the present invention, the at least one induction heating unit 3 is positioned adjacent a planar bottom surface 100 of the fixed train track rail 10 and a planar bottom surface 110 of the moving-point train track rail 11. The holding case 5 is used to position the induction coil 4 of the at least one induction heating unit 3 adjacent the planar bottom surface 100 of the fixed train track rail 10 and the planar bottom surface 110 of the moving-point train track rail 11. The mounting tray 9 is used to establish a connection with the fixed train track rail 10 and the moving-point train track rail 11. The mounting tray 9 is designed to accommodate the shift of the moving-point train track rail 11 which is generally about to 7-inches. The positioning of the induction coil 4 is vital to induce eddy current magnetic fields on both the fixed train track rail 10 and the moving-point train track rail 11 simultaneously.

As seen in FIG. 4, to hold and orient the induction coil 4 in an optimal position, the holding case 5 comprises a rail-facing top surface 6, a structural body 7, and a tray-facing bottom surface 8. The rail-facing top surface 6 and the tray-facing bottom surface 8 are positioned opposite to each other across the structural body 7 such that a distance between the rail-facing top surface 6 and the tray-facing bottom surface 8 determines an overall thickness of the holding case 5. In other words, the structural body 7 extends from the rail-facing top surface 6 to the tray-facing bottom surface 8. The size and overall shape of the holding case 5 can be different from one embodiment to another. For the induction coil 4 to induce eddy current magnetic fields onto the moving-point train track rail 11 and the fixed train track rail 10, the induction coil 4 is positioned within the holding case 5 adjacent the rail-facing top surface 6. On the other hand, the tray-facing bottom surface 8 is connected to a receiving surface 27 of the mounting tray 9 such that the holding case 5 remains stationary within the mounting tray 9. The holding case 5 further comprises an electrically-insulative potting 30 that protects the induction coil 4 from varying weather conditions and vibrations. To do so, the induction coil 4 is positioned within the holding case 5 by the electrically-insulative potting 30. The electrically-insulative potting 30 can be, but is not limited to, fiberglass resin. Preferably, the holding case 5 will be designed to be waterproof.

As discussed earlier, the present invention is used in the process of removing snow or ice from the area in between a fixed train track rail 10 and a moving-point train track rail 11. As further illustrated in FIG. 4, the holding case 5 is positioned adjacent and in parallel to the planar bottom surface 100 of the fixed train track rail 10. Moreover, the holding case 5 is also positioned adjacent and in parallel to the planar bottom surface 11 of the moving-point train track rail 11. Since the induction coil 4 is adjacent the rail-facing top surface 6 of the holding case 5, the induction coil 4 will also be positioned adjacent the planar bottom surface 100 of the fixed train track rail 10 and the planar bottom surface 110 of the moving-point train track rail 11. In the resulting position, the holding case 5 will be positioned in between the mounting tray 9 and the planar bottom surface 100 of the fixed train track rail 10 and the planar bottom surface 110 of the moving-point train track rail 11.

As seen in FIG. 3 and FIG. 4, to attach to the railroad switch, the mounting tray 9 comprises a first lateral wall 28 and a second lateral wall 29. The mounting tray 9 is designed to externally connect to the fixed train track rail 10 and accommodate the shift of the moving-point train track rail 11. To do so, the first lateral wall 28 is terminally and perpendicularly connected to the receiving surface 27. On the other hand, the second lateral wall 29 is terminally and perpendicularly connected to the receiving surface 27 opposite the first lateral wall 28 across the receiving surface 27. As a result, the receiving surface 27 will be positioned in between the first lateral wall 28 and the second lateral wall 29.

When the mounting tray 9 is attached to the fixed train track rail 10, the first lateral wall 28 is externally mounted to a body of the fixed train track rail 10 opposite the moving-point train track rail 11 through an attachment mechanism that can vary in different embodiments of the present invention. In the resulting position, the second lateral wall 29 is positioned adjacent the moving-point train track rail 11 opposite the fixed train track rail 10. More specifically, the second lateral wall 29 is positioned to allow the moving-point train track rail 11 to have a full range of motion. When the first lateral wall 28 and the second lateral wall 29 are appropriately positioned, the receiving surface 27 of the mounting tray 9 is positioned in parallel to the planar bottom surface 100 of the fixed train track rail 10. The receiving surface 27 is connected to a railroad tie opposite the holding case 5 so that the mounting tray 9 is secured at the receiving surface 27. Even though the at least one induction heating unit 3 is configured to be positioned underneath both the fixed train track rail 10 and the moving-point train track rail 11 in the preferred embodiment, the at least one induction heating unit 3 can be positioned lateral to the body of the fixed train track rail 10 or in a different functional position in other embodiment of the present invention.

Figure 2:
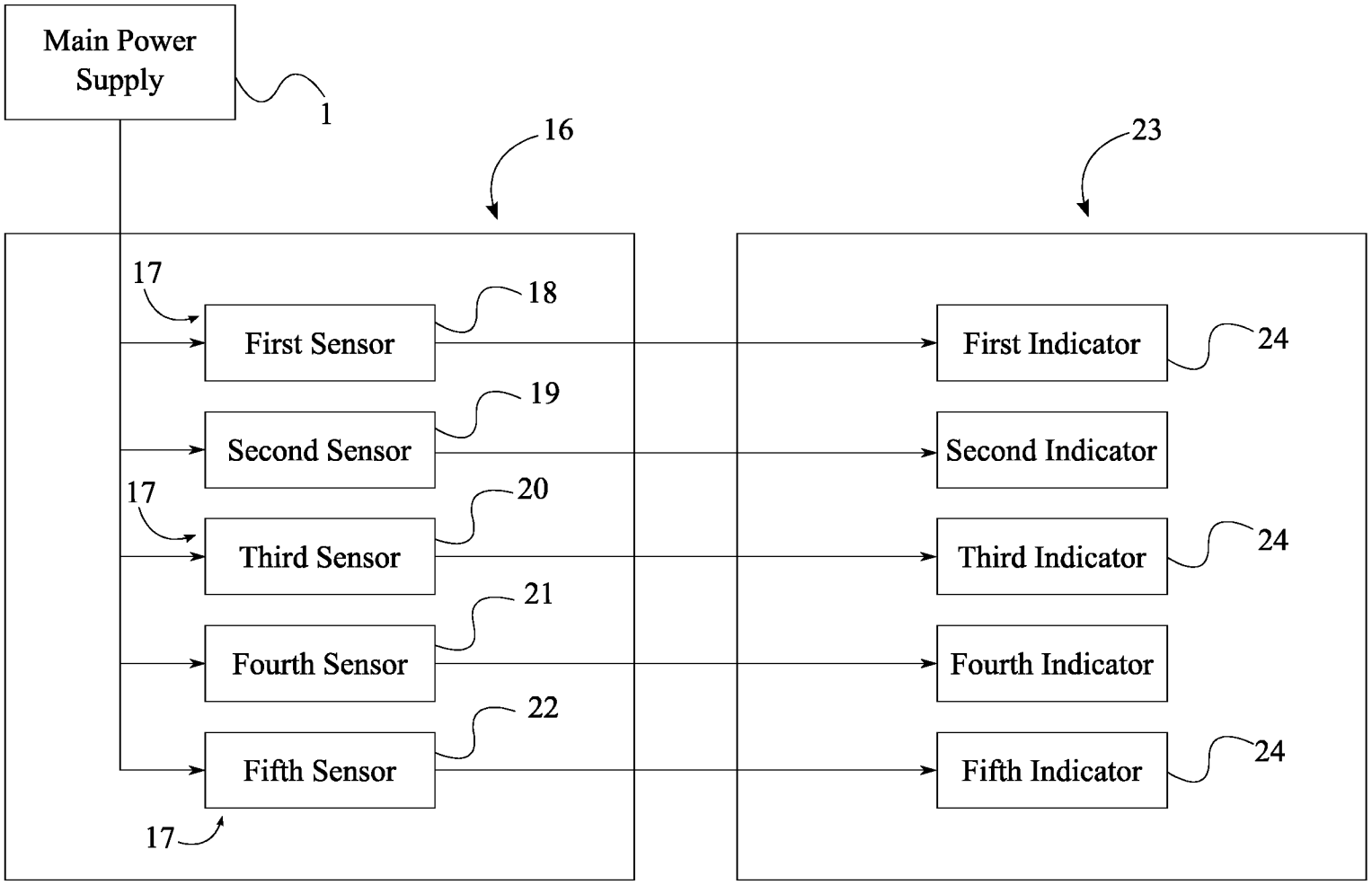
FIG. 2 is an illustration of the alarm driver and the notification panel.

As shown in FIG. 2, to continuously monitor the present invention and ensure that the present invention is functioning at full capability, the present invention further comprises an alarm driver 16 that notifies the user if a certain aspect of the present invention is underperforming. The alarm driver 16 is electrically connected to the main power supply 1 through the DC driving unit 15 so that the required power can be drawn from the main power supply 1. The alarm driver 16 is also electronically connected to the control unit 2 so that the microcontroller within the control unit 2 has access to the alarm driver 16. For user control purposes, the alarm driver 16 is also electronically connected to the interface driver 12. To monitor and receive updates from each of the components of the present invention, the alarm driver 16 comprises a plurality of sensors 17. To monitor the performance of the main power supply 1, a first sensor 18 from the plurality of sensors 17 is integrated into the main power supply 1. To monitor the performance of the at least one filter coil 13, a second sensor 19 from the plurality of sensors 17 is integrated into the at least one filter coil 13. To monitor the performance of the at least one power transistor 14, a third sensor 20 from the plurality of sensors 17 is integrated into the at least one power transistor 14. To monitor the performance of the DC driving unit 15, a fourth sensor 21 from the plurality of sensors 17 is integrated into the DC driving unit 15. To monitor the functionality the control unit 2, a fifth sensor 22 is integrated into the control unit 2. In addition to monitoring performance related aspects, the plurality of sensors 17 can also be used to retrieve information that can be, but is not limited to, environment temperature. Since the alarm driver 16 is electronically connected to the control unit 2, the microcontroller has the capability of utilizing the plurality of sensors 17.

As further illustrated in FIG. 2, to update the user with performance related information, the present invention further comprises a notification panel 23 that comprises a plurality of indicators 24. Each of the plurality of sensors 17 is electronically connected to a corresponding indicator from the plurality of indicators 24 so that the corresponding indicator can illuminate according to the signal received from the corresponding sensor. As an example, if the first sensor 18 is electronically connected to a first indicator of the plurality of indicators 24, the first indicator will illuminate according to the signal received from the first sensor 18. Since the first sensor 18 is integrated into the main power supply 1, the first indicator will notify the user regarding the status of the main power supply 1. Each of the plurality of indicators 24 can be, but is not limited to, a light-emitting diode.

For the user to have remote access, the present invention further comprises a wireless cellular modem 25 that is electronically connected to the interface driver 12 through a programmable logic controller (PLC) unit 26. The wireless cellular modem 25 functions as an access point for the user to control the present invention remotely. The PLC unit 26 interprets an incoming signal received at the wireless cellular modem 25. Furthermore, the wireless cellular modem 25 also allows the user to receive notifications from the present invention. In such instances, the PLC unit 26 interprets an outgoing signal directed to the wireless cellular modem 25.

When the present invention is in use, the plurality of sensors 17 is initially used for self-diagnostic purposes which are initiated by the microcontroller embedded in the control unit 2. A specific sensor selected from the plurality of sensors 17 is used to determine if the induction coil 4 is positioned within sufficient range to heat the steel of the railroad switch. A pulsed eddy current field is generated to determine the range of the induction coil 4. If the induction coil 4 is not within the required range of the railroad switch, the specific sensor is triggered. If the induction coil 4 is within the required range of the railroad switch, the microcontroller proceeds to check the connection cabling and ground fault connections of the present invention. If the connection cabling is not proper a corresponding sensor from the plurality of sensors 17 is triggered to notify the user. The user will be notified through the notification panel 23. If the connection cabling is proper, the microcontroller proceeds to check the ambient weather conditions surrounding the present invention to ensure that the temperature is below freezing point. If the temperature is determined to be below freezing point, the microcontroller initiates the process of generating the eddy current field. As a result of the eddy current field generated by the induction coil 4, the atoms within the steel are excited resulting in elevated temperatures. Thus, snow or ice accumulated within the railroad switch is removed due to the heat radiated from the moving-point train track rail 11 and the fixed train track rail 10.

Although the invention has been explained in relation to its preferred embodiment, it is to be understood that many other possible modifications and variations can be made without departing from the spirit and scope of the invention as hereinafter claimed.

What is claimed is:

1. An induction coil driver card for a railroad switch heater system comprises:

a main power supply;

a control unit;

at least one induction heating unit;

an interface driver;

the at least one induction heating unit comprises an induction coil;

the main power supply being electrically connected to the control unit, the interface driver, and the induction coil;

the control unit being electronically connected to the interface driver;

the control unit being electronically connected to the induction coil;

a direct current (DC) driving unit;

the main power supply being electrically connected to the control unit through the DC driving unit; and the main power supply being electrically connected to the interface driver through the DC driving unit.

2. The induction coil driver card for a railroad switch heater system as claimed in claim 1 further comprises:

at least one filter coil;

at least one power transistor;

the at least one filter coil being electronically connected to the at least one power transistor;

the main power supply being electrically connected to the at least one induction heating unit through the at least one filter coil and the at least one power transistor; and the control unit being electronically connected to the at least one induction heating unit through the at least one power transistor.

3. The induction coil driver card for a railroad switch heater system as claimed in claim 1, wherein the induction coil is oblong and concave in shape.

4. The induction coil driver card for a railroad switch heater system as claimed in claim 1 further comprises:

the at least one induction heating unit further comprises a holding case, and a mounting tray;

the induction coil being positioned within the holding case; and the holding case being connected to a receiving surface of the mounting tray.

5. The induction coil driver card for a railroad switch heater system as claimed in claim 4 further comprises:

the holding case comprises a rail-facing top surface, a structural body, and a tray-facing bottom surface;

the structural body extending from the rail-facing top surface to the tray-facing bottom surface;

the induction coil being positioned within the holding case adjacent the rail-facing top surface; and the holding case being connected to the receiving surface at the tray-facing bottom surface.

6. The induction coil driver card for a railroad switch heater system as claimed in claim 4 further comprises:

the holding case further comprises an electrically-insulative potting; and the induction coil being positioned within the holding case by the electrically-insulative potting.

7. The induction coil driver card for a railroad switch heater system as claimed in claim 4 further comprises:

a fixed train track rail;

a moving-point train track rail;

the mounting tray further comprises a first lateral wall and a second lateral wall;

the holding case being positioned adjacent and in parallel to a planar bottom surface of both the fixed train track rail and the moving-point train track rail;

the first lateral wall being terminally and perpendicularly connected to the receiving surface;

the second lateral wall being terminally and perpendicularly connected to the receiving surface opposite the first lateral wall;

the first lateral wall being externally connected to a body of the fixed train track rail opposite the moving-point train track rail; and the second lateral wall being positioned adjacent the moving-point train track rail opposite the fixed train track rail.

8. The induction coil driver card for a railroad switch heater system as claimed in claim 1 further comprises:

an alarm driver;

the alarm driver comprises a plurality of sensors;

the main power supply being electrically connected to the alarm driver;

the alarm driver being electronically connected to the control unit and the interface driver;

a first sensor from the plurality of sensors being integrated into the main power supply;

a second sensor from the plurality of sensors being integrated into at least one filter coil;

a third sensor from the plurality of sensors being integrated into at least one power transistor;

a fourth sensor from the plurality of sensors being integrated into a DC driving unit; and a fifth sensor from the plurality of sensors being integrated into the control unit.

9. The induction coil driver card for a railroad switch heater system as claimed in claim 8 further comprises:

a notification panel;

the notification panel comprises a plurality of indicators; and each of the plurality of sensors being electronically connected to a corresponding indicator from the plurality of indicators.

10. The induction coil driver card for a railroad switch heater system as claimed in claim 1 further comprises:

a wireless cellular modem; and the wireless cellular modem being electronically connected to the interface driver through a programmable logic controller (PLC) unit.

11. The induction coil driver card for a railroad switch heater system as claimed in claim 1, wherein the main power supply is a 120-Volt alternating current power supply.

* * * * *